United States Patent [19]

Kikuchi

[11] 4,231,584

[45] Nov. 4, 1980

[54] SKI BOOT HEEL BINDING EQUIPPED WITH SKI BRAKE

[75] Inventor: Toshikazu Kikuchi, Nagareyama, Japan

[73] Assignee: Hope Co., Ltd., Tokyo, Japan

[21] Appl. No.: 971,253

[22] Filed: Dec. 18, 1978

[30] Foreign Application Priority Data

Dec. 21, 1977 [JP] Japan ..... 52/152960
Jul. 10, 1978 [JP] Japan ..... 53/82958

[51] Int. Cl.[3] ..... A63C 7/10
[52] U.S. Cl. ..... 280/604; 280/605
[58] Field of Search ..... 280/604, 605

[56] References Cited

U.S. PATENT DOCUMENTS 3,909,024 9/1975 Salomon ..... 280/605
3,933,361 1/1976 Beyl ..... 280/605
3,992,030 11/1976 Salomon ..... 280/605
4,116,461 9/1978 Krob et al. ..... 280/605

FOREIGN PATENT DOCUMENTS 2613016 9/1977 Fed. Rep. of Germany ..... 280/605
2635155 2/1978 Fed. Rep. of Germany ..... 280/605

*Primary Examiner*—John J. Love
*Assistant Examiner*—D. W. Underwood
*Attorney, Agent, or Firm*—Wenderoth, Lind & Ponack

[57] ABSTRACT

In a ski boot heel binding comprising a heel supporting body slidably mounted on a base plate, a transverse shaft is rotatably supported by the supporting body and has fixed thereto a ski brake and a lever to rotate together with the shaft. The lever is operatively connected with a stationary part of the base plate in such a manner that when the supporting body slides back or forth along the base plate, the lever rotates about the stationary part of the base plate.

7 Claims, 11 Drawing Figures

FIG. 5
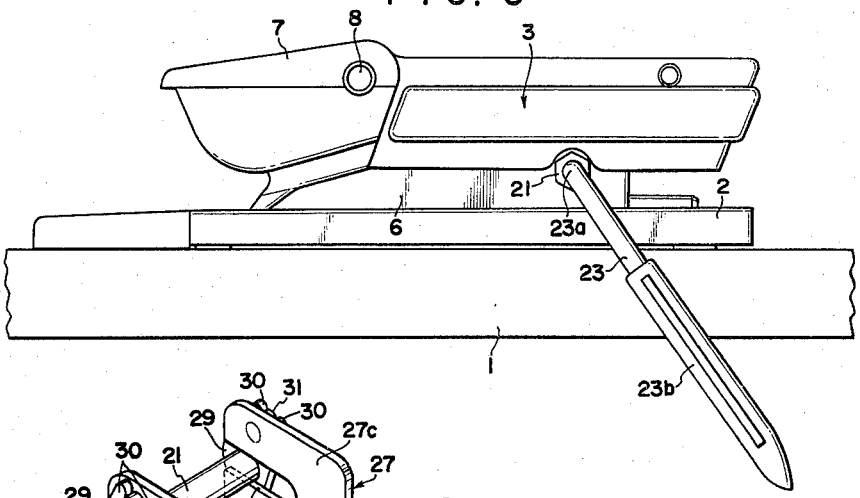
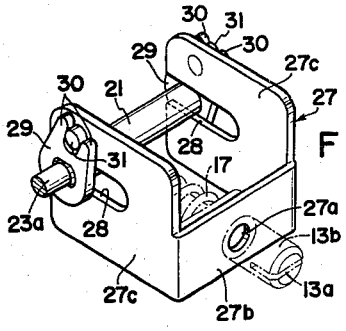
FIG. 7
FIG. 6
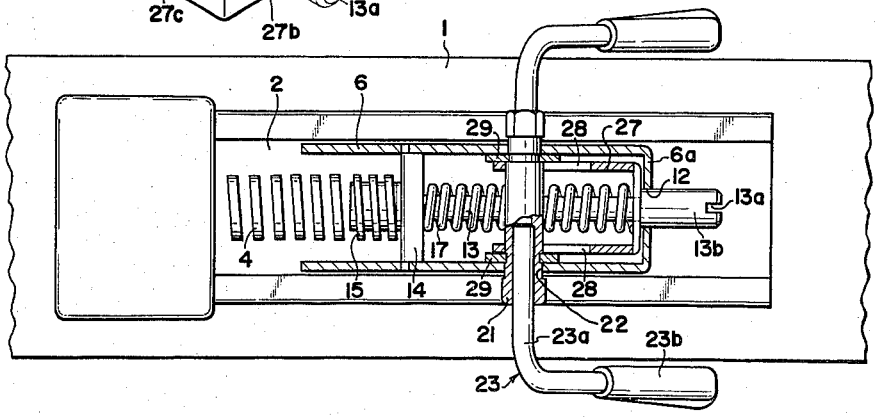

SKI BOOT HEEL BINDING EQUIPPED WITH SKI BRAKE

BACKGROUND OF THE INVENTION

This invention relates to a ski boot heel binding equipped with a ski brake.

Conventionally, a ski brake has been provided separately from a heel binding and mounted on the upper surface of a ski plate by screws where a ski boot is stepped in. Accordingly, it has been troublesome for ski shops to mount the ski brake apart from the heel binding. In addition, many screw holes made through the ski plate for mounting both of the ski brake and the heel binding have weakened the strength of the ski plate.

A more serious problem has been experienced when a conventional ski brake made of a spring wire or spring plate is used. Such a ski brake retains an upward stress when depressed by a ski boot, so that a certain upward force tending to release the heel binding is always applied thereto. Accordingly, even when the heel binding having an accurately preset critical releasing force is used, the upward stress of the ski brake will cause an error in the critical releasing force of the binding and the binding will be displaced to the heel releasing position by an upward shock less than the preset critical releasing force.

In view of the above disadvantages of the ski brake, there is provided a ski boot heel binding equipped with a ski brake as shown in German Patent Application No. P 26 130 16. In this ski boot heel binding, the ski brake is assembled to be operated by the sliding movement of the heel binding. That is, the ski brake rotates toward a rest position when the binding slides back by engagement with the ski boot and, on the contrary, the ski brake rotates toward an operative position when the binding slides forwardly along the ski by releasing the ski boot therefrom.

However, the boot heel binding slides only a short length along the ski when the ski boot is engaged and released, so that it has been difficult to convert such a short length of sliding movement of the heel binding into adequate rotational movement of the ski brake.

SUMMARY OF THE INVENTION

Accordingly, an object of the present invention is to provide a ski boot heel binding equipped with a ski brake wherein a small amount of sliding movement of the heel binding can be converted into an adequate amount of rotational movement of the ski brake.

Another object of the present invention is to provide a ski boot heel binding equipped with a ski brake which is simple in structure and reliable in operation.

The present invention is adapted to a ski boot heel binding comprising a supporting body mounted on a base plate to be slidable along the ski and a spring means urging the supporting body forwardly but allowing the supporting body to move backwardly when a ski boot is engaged therewith. According to the present invention, a transverse shaft is rotatably supported by the supporting body, to which transverse shaft a ski brake as well as a lever means is secured to rotate therewith. The lever means is operatively connected with a stationary part of the base plate in such a manner that when the supporting body slides back or forth along the base plate, the lever means rotates about the stationary part of the base plate. The ski brake projects below the ski plate when the supporting body slides forwardly and is lifted above the ski plate when the supporting body slides back.

Preferably, the lever means comprises a pair of first and second levers pivoted with each other at first ends thereof, wherein the first lever is rotatably connected at the second end thereof to the stationary part on the base plate while the second lever is secured at the second end thereof to the transverse shaft.

More preferably, the lever means is composed of a single lever secured at one end thereof to the shaft member. One of the lever and the stationary part on the base plate is provided with a cut-out portion and the other is provided with a pin. The cut-out portion and the pin are engaged with each other in such a manner that when the supporting body slides along the base plate, the lever swings about the pin. The cut-out portion may be a U-shaped slit in the lever to which the pin on the stationary part of the base plate is slidably engaged.

Other objects and features of the present invention will become apparent from the following description of preferred embodiments when taken in conjunction with the accompanying drawings, in which:

BRIEF DESCRIPTION OF THE DRAWINGS

FIG. 5 is a side view of a ski boot heel binding equipped with a ski brake according to a second embodiment of the present invention, FIG. 6 is a partially sectioned top plan view of the binding shown in FIG. 5, FIG. 7 is a perspective view showing essential parts of the binding according to the second embodiment.

DETAILED DESCRIPTION OF PREFERRED EMBODIMENTS

Figure 1:
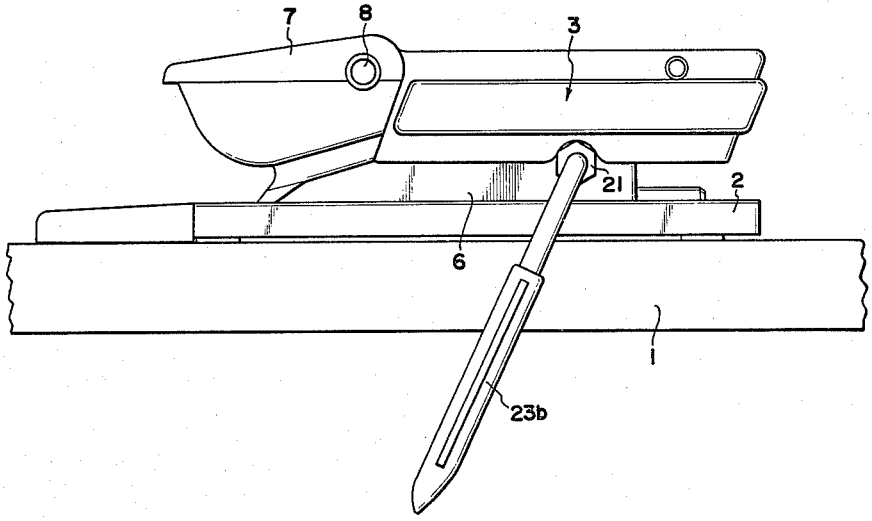
FIG. 1 is a side view showing a ski boot heel binding equipped with a ski brake according to a first embodiment of the present invention.
Figure 2:
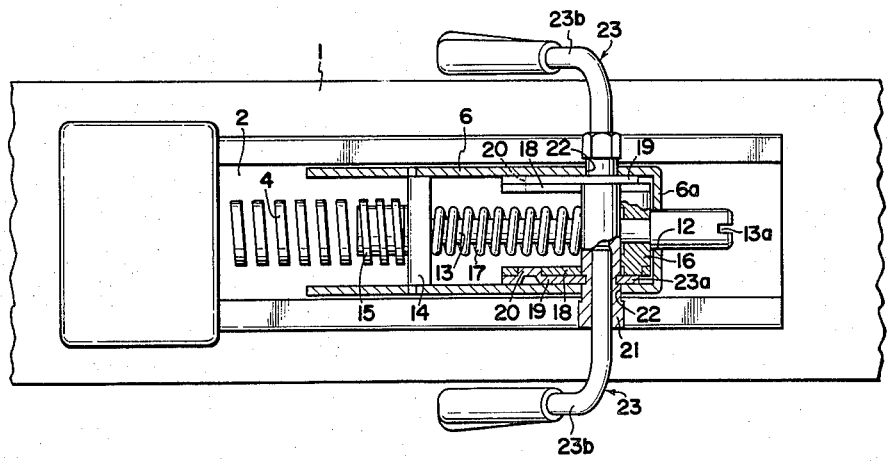
FIG. 2 is a partially sectioned top plan view of the binding shown in FIG. 1.

Referring to a first embodiment of the present invention shown in FIGS. 1 through 4, reference numeral 1 denotes a ski plate on which a base plate 2 is mounted by known means such as screws. The base plate 2 is used for mounting a heel holding main body 3 thereon. The base plate 2 is provided at the front center portion thereof with a rack 4 and at both side edges thereof with guide grooves 5—5 having an inverted "L" shape in section. The main body 3 has a supporting frame 6 substantially in the shape of a "U" in a sectional plan view as shown in FIG. 2. Provided at the front end portion of the frame 6 is a heel engaging jaw 7 pivoted by a shaft 8 to be upwardly displaceble. The heel engaging jaw 7 is elastically connected with the frame 6 by means of a locking spring 9 urging a cam member 10 against a transverse rod 11 in the jaw 7. When a severe upward thrust is applied to the jaw 7 through a boot heel in the heel engaging position shown in FIG. 3, the transverse rod 11 in the jaw pushes back the cam member 10 about the shaft 8 against the force of the locking spring 9 and moves up along the front surface of the cam member, whereby the jaw takes a boot releasing position. The structure which elastically interconnects the heel engaging jaw 7 with the main body has no direct connection with the present invention and many other similar structures can be employed.

The supporting frame 6 has L-shaped flanges at both lower side ends thereof, which are slidably engaged with the guide grooves 5—5 in the base plate 2. The frame 6 is also provided with a hole 12 through the rear end wall 6*a* thereof, through which a rod 13 extends forwardly and is rotatably supported by a lateral plate 14 secured between the side walls of the frame 6. A worm 15 is fixed to the front end of the rod 13 and engages with the rack 4 on the base plate. Extending between the side walls of the frame 6 at the lower rear ends thereof is a cross bar 16 through which the rod 13 extends rotatably at right angles therewith. A horizontal spring 17 to urge the supporting frame forwardly is provided under compression between the lateral plate 14 and the cross bar 16. Accordingly, when the rod 13 is rotated by a screw driver or a coin fitted into a groove 13*a* on the rear end of the rod 13, the supporting frame 6, i.e. the heel holding main body 3 can be moved forwardly or backwardly by the engagement of the worm 15 with rack 4, so that the forward pressure of the heel binding can be adjusted.

Figure 3:
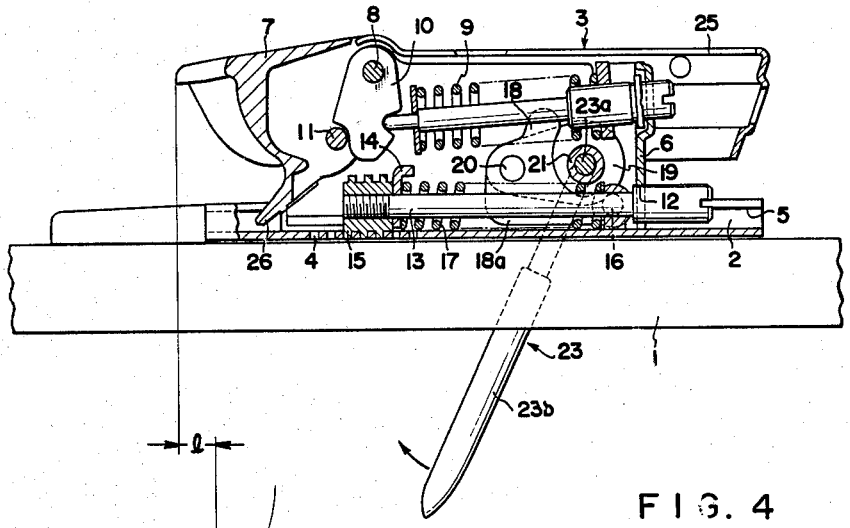
FIG. 3 is a partially sectioned side view of the same binding wherein the binding is at the forwardly advanced position.
Figure 4:
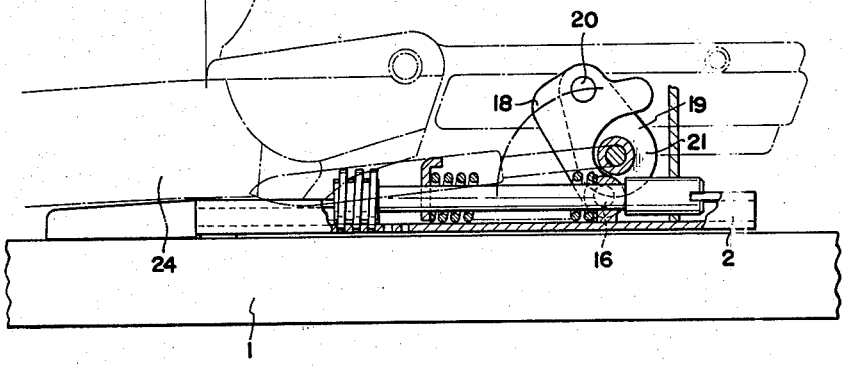
FIG. 4 is a partially sectioned side view of the same binding wherein the binding is at the backwardly retreated position.

In this embodiment, a pair of first levers 18—18 are pivoted at the rear ends thereof to both side ends of the cross bar 16 and at the forward ends thereof to pins 20—20 integrally formed on the forward ends of a pair of second levers 19—19. The second levers 19—19 are secured at the rear end portions thereof with a hollow transverse shaft 21. These first and second levers 18 and 19 are pivoted with each other in such a manner that when the main body 3 is at the advanced position without holding the boot heel as shown in FIG. 3, the pivot pin 20 for the both levers 18 and 19 is located above the level of the cross bar 16 but slightly below the level of the transverse shaft 21. The hollow transverse shaft 21 is rotatably supported in bearing holes 22—22 made through the side walls of the supporting frame 6. Each of a pair of ski brakes 23—23 has a shaft portion 23*a* threadedly inserted into and engaged with the hollow part of the transverse shaft 21, so that when the transverse shaft 21 rotates in the bearing holes 22—22 of the supporting frame, the ski brakes 23—23 rotate also together with the transverse shaft 21.

Each ski brake 23 has an arm 23*b* folded substantially at right angles with respect to the shaft portion 23*a*. The arm 23*b* has a length long enough to be extensible beyond the lower surface of the ski plate and can be displaced to a level above the lower surface of the ski plate when the shaft portion 23*a* of the brake is rotated in the clockwise direction from the position shown in FIGS. 1 through 3.

Now, reference is made to the operation of the present binding equipped with the ski brakes. In the position shown in FIGS. 1 through 3, a ski boot heel is not engaged with the binding, so that the compression spring 17 for the forward pressure of the binding is relaxed and that the lateral plate 14 provided between the side walls of the supporting frame for receiving the front end of the spring 17 abuts against the rear surface of the worm 15, whereby the heel binding takes a forwardly advanced position. In this advanced position, the lower end surface 18*a* of the first lever 18 contacts the upper surface of the base plate 2, and the pivot pin 20 for the both levers is located above the cross bar 16 but below the transverse shaft 21. In such an arrnagement, the arms 23*b*—23*b* of the ski brakes 23—23 project below the ski plate 1.

At the advanced position of the heel binding, after displacing the heel engaging jaw 7 upwardly about the shaft 8 by operating an unlocking lever 25, a toe of the ski boot is fitted to a toe binding (not shown) and then the heel 24 is engaged with the jaw 7. At the time when a pedal 26 integral with the jaw 7 is pressed down by the sole of the heel, the supporting frame 6 slides backwardly along the base plate 2. The backward sliding movement of the supporting frame 6 is allowed since the lateral plate 14 moves back by compressing the horizontal spring 17. By this movement of the supporting frame 6, the hole 12 formed through the rear end wall of the frame is moved toward the rear end portion of the rod 13 and the lateral plate 14 is rearwardly separated from the worm 15. The distance of this backward movement of the supporting frame 6 is shown by symbol "l" between FIG. 3 and FIG. 4.

When the supporting frame 3 slides back along the base plate, the transverse shaft 21 mounted on the frame 3 is also moved back, so that the second lever 19 secured to the shaft 21 acts to pull back the first lever 18 through the pivot pin 20. Since the first lever 18 is rotatably connected to the cross bar 16 which is secured relative to the base plate 2, the first lever 18 rotates about the cross bar 16 in the clockwise direction in FIG. 3 when pulled back by the second lever. Therefore, by the rotation of the first lever 18, the second lever 19 rotates in the same direction by means of the pivotable engagement with the pin 20, whereby the transverse shaft 21 secured to the second lever 19 rotates in the same clockwise direction. By the rotation of the transverse shaft 21, the ski brakes 23 are rotated to displace the arms 23*b* thereon above the lower surface of the ski plate. Thus, when the present heel binding is engaged with the ski boot by stepping the heel therein, the arms of the ski brakes are displaced above the lower surface of the ski plate and cannot be shifted below it unless the ski boot heel is disengaged from the binding.

On the contrary, when the ski boot is disengaged from the heel binding, the supporting frame 6 is advanced forwardly by the horizontal spring 17 until the lateral plate 14 abuts against the rear end surface of the worm 15. Accordingly, the first and second levers 18 and 19 rotate in the counterclockwise direction from the position shown in FIG. 4 and take the position shown in FIG. 3.

The ski boot heel binding equipped with the ski brake according to the above first embodiment can effectively convert the small sliding movement of the supporting frame 6 into a large rotational movement of the ski brake 23 by pivotable engagement of the first and second levers 18 and 19.

Referring to a second embodiment of the present invention shown in FIG. 5 through FIG. 9, reference numerals which are the same as those in the first embodiment designate similar parts. The ski brakes 23—23 in the second embodiment are assembled in the binding such that the arms **23*b*—23*b*** of the brakes can be displaced upwardly and behind the binding when the supporting frame is moved back by engagement with the ski boot.

In this second embodiment, a spring-receiving member 27 substantially U-shaped in plan view is provided inside the supporting frame 6. The member 27 has a hole **27*a* in the rear end wall 27*b* thereof through which the rod 13 extends. The rod 13 has an enlarged head portion 13*b*, which loosely passes through the hole 12 in the supporting frame 6 but abuts at the front annular end thereof against the rear end wall 27*b* of the spring-receiving member 27. This member 27 also has vertical side walls 27*c*—27*c* in which guide slits 28—28 are formed in the horizontal direction from the front ends thereof toward the middle portions thereof. Provided through the guide slits 28—28 is a hollow transverse shaft 21 which passes through bearing holes 22 in the supporting frame 6 and is rotatably supported therein. The transverse shaft 21 has a pair of levers 29—29 integrally fixed thereto at both side ends thereof, each of which has bifurcated fingers 30—30 slidably interposing therebetween a pin 31 fixed on the front upper part of the vertical side wall of the member 27. The hollow transverse shaft 21 has secured therein horizontal portions 23*a*—23*a* of the ski brakes 23—23 by threaded engagement or the like, so that when the transverse shaft 21 rotates in the bearing holes 22—22** in the supporting frame, the ski brakes rotate therewith.

Figure 8:
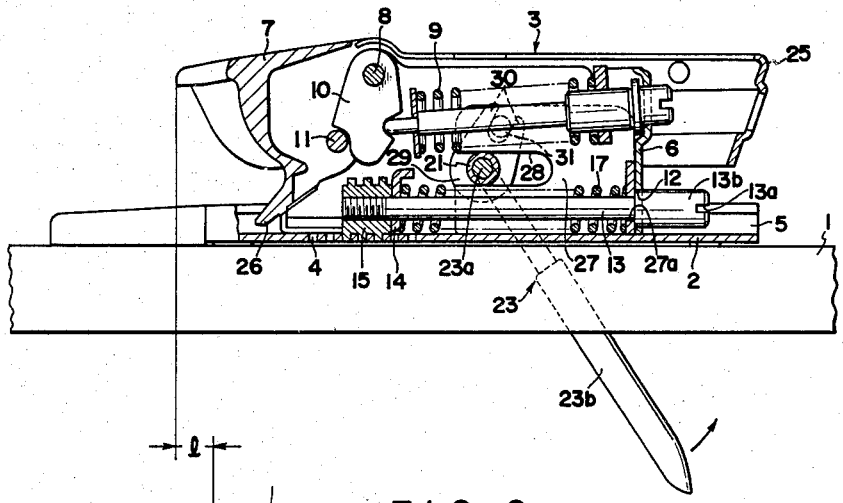
FIG. 8 is a partially sectioned side view of the same binding as shown in FIG. 5 wherein the binding is at the forwardly advanced position.

Referring to the operation of the binding according to the second embodiment, the binding shown in FIG. 8 takes an advanced position without engaging with the boot heel. In this advanced position, the transverse shaft 21 is located at the front end portion of the guide slits 28—28 and a line connecting the center of the shaft 21 to the pin 31 in FIG. 8 is inclined backwardly relative to the vertical. The arms **23*b*—23*b* of the ski brakes 23—23 are inclined backwardly below the ski plate from the shaft portions 23*a*—23*a*** thereof.

When the binding at the advanced position is engaged with the ski boot in the same way as mentioned with regard to the first embodiment, the supporting frame 6 as well as the heel engaging jaw 7 is moved back along the base plate 2, whereby the lateral plate 14 secured to the supporting frame is backwardly separated from the worm 15 and compresses the horizontal spring 17. However, the spring-receiving member 27 is stationary relative to the base plate 2 since the rear end surface of the member 27 abuts against the front end surface of the enlarged head portion 13 of the rod 13. The distance of this backward movement of the supporting frame is shown by "l" between FIG. 8 and FIG. 9.

Figure 9:
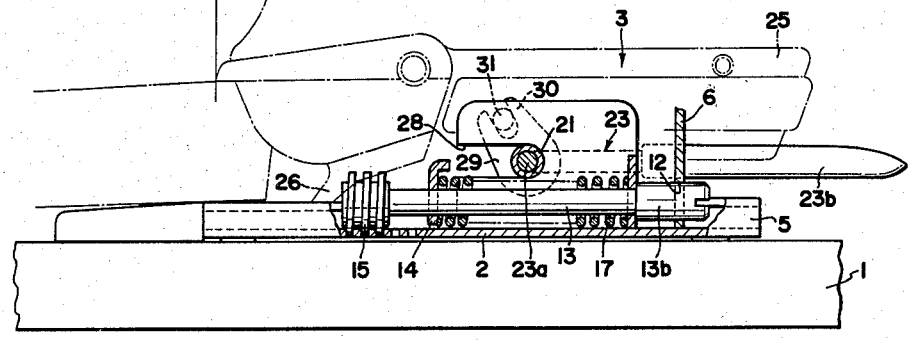
FIG. 9 is a partially sectioned side view of the same binding as shown in FIG. 8 wherein the binding is at the backwardly retreated position.

While the supporting frame 6 slides back along the base plate 2, the hollow transverse shaft 21 supported by the frame 6 moves back through the horizontal guide slits 28—28 in the side walls of the spring-receiving member 27. At this time of backward movement of the transverse shaft 21, each lever 29 fixed to the shaft 21 rotates about the pin 31 since the bifurcated fingers 30—30 of the lever are slidably engaged with the pin 31 on the spring-receiving member 27. Accordingly, the lever 29 partially rotates in the counterclockwise direction from the position shown in FIG. 8 to the position in FIG. 9, so that the transverse shaft 21 fixed to the levers 29—29 and the ski brakes 23—23 fixed to the shaft 21 rotate in the same direction. Thus, the arms **23*b*—23*b* of the ski brakes are displaced above the lower surface of the ski and behind the binding as shown in FIG. 9** and maintain this position unless the ski boot is disengaged from the binding.

On the other hand, when the ski boot is disengaged from the binding, the supporting frame 6 as well as the jaw 7 is advanced forwardly by the action of the horizontal spring 17 in the same manner as mentioned with regard to the first embodiment. During the advancement of the supporting frame 6, the transverse shaft 21 is rotated in the clockwise direction by means of the slidable engagement of the levers 29—29 with the pins 31—31, whereby the arms of the ski brakes fixed to the shaft 21 extend below the ski plate.

The ski boot heel binding according to the second embodiment is very simple in structure since the ski brake is operated by the sliding engagement of the single lever 29 with the pin 31. Although the structure of the binding according to this second embodiment is simple, the small amount of sliding movement of the binding can effectively be converted into a sufficient rotational movement of the ski brake.

Figure 10:
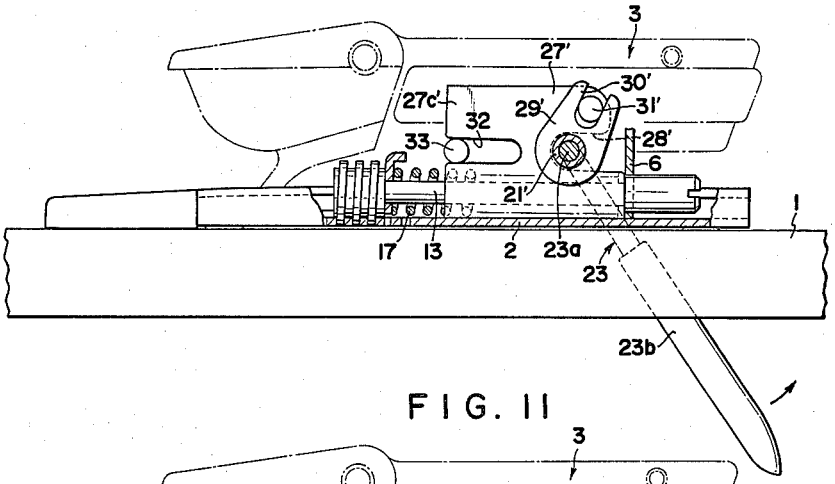
FIG. 10 is a partially sectioned side view of a ski boot heel binding equipped with a ski brake according to a third embodiment of the present invention.

Reference is now made to a third embodiment of the present invention shown in FIG. 10, in which the same reference numerals are used to designate the same parts as used in the first and second embodiments. The structure of the third embodiment is similar to that of the second embodiment in that the ski brake 23 is operated by a sliding engagement of a lever 29' with a pin 31' integrally fixed on a spring-receiving member 27'. The spring-receiving member 27' is provided with horizontal guide slits 28'—28' at the rear portions of the vertical side walls **27*c*'—27*c*' to allow the transverse shaft 21 to be moved backwardly. The pin 31', which is interposed between fingers 30' of the lever 29', is integrally fixed to the upper rear end portion of the side wall of the spring-receiving member 27'. The spring-receiving member 27' is also provided with horizontal slits 32—32 extending from the front ends to the center parts of the side walls 27*c*'—27*c*'. A pin 33 secured to the supporting frame 6 is slidably engaged in each slit 32. The engagement of the pin 33 with the slits 32 serves to prevent the spring-receiving member 27' from inclining relative to the base plate when the lever 29' rotates about the pin 31'**. The other structures of the third embodiment are substantially same as those of the second embodiment.

The operation of the ski brake in the third embodiment is also substantially same as that of the second embodiment. Namely, when the supporting frame moves back from the advanced position by engagement with the ski boot, the transverse shaft 21' supported by the frame also moves back along the guide slits 28'—28', during which time due to the engagement of the lever 29' with the pin 31', the shaft 21' fixed to the lever 29' as well as the ski brake 23 fixed to the shaft 21' rotates in the counterclockwise direction as shown in FIG. 10. Thus, the arm **23*b* of the ski brake is lifted to a level above the lower surface of the ski. On the other hand, when the ski boot is disengaged from the binding, the transverse shaft 21' moves and rotates in the reverse direction, whereby the arm 23*b* of the ski brake is extended below the lower surface of the ski plate 1**.

Figure 11:
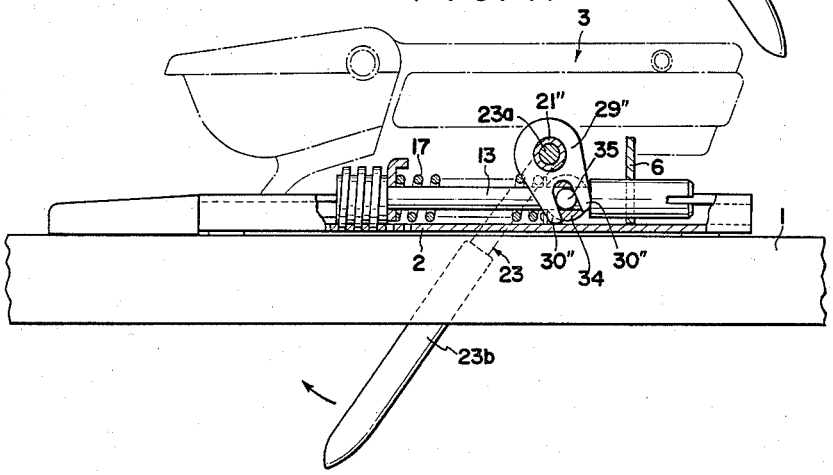
FIG. 11 is a partially sectioned side view of a ski boot heel binding equipped with a ski brake according to a fourth embodiment of the present invention.

Referring to a fourth embodiment of the present invention shown in FIG. 11, reference numerals the same as used in the previous embodiments designate the same parts. In this binding, a cross bar 34 is provided across the side walls of the supporting frame 6 to allow the rod 13 for adjusting the horizontal spring 17 to rotatably intersect therewith. A ski brake 23 is secured to the transverse shaft 21" with the arm 23*b* thereof extending forwardly below the ski plate 1 in the advanced position shown in FIG. 11. The transverse shaft 21" is rotatably supported on the frame 6 and has levers 29"—29" integrally fixed thereto. Bifurcated fingers 30" of the lever 29" are inclined downwardly and backwardly and slidably interpose therebetween a pin 35 at the side end of the cross bar 34. The other structures of the fourth embodiment are substantially the same as those of the second embodiment.

In this embodiment, when the supporting frame slides back along the base plate 2, the lever 29" rotates in the clockwise direction about the pin 35 in FIG. 11, so that the transverse shaft 21" as well as the ski brake 23 fixed thereto rotates in the same direction to displace the arm 23*b* of the brake to a level above the lower surface of the ski plate. On the contrary, when the supporting frame 6 advances forwardly by disengagement with the ski boot, the lever 29" rotates in the counterclockwise direction and, thereby, the arm of the ski brake 23 projects below the ski plate as shown in FIG. 11.

Although the present invention has been described with reference to preferred embodiments thereof, many modifications and alterations may be made within the spirit of the present invention. For example, the transverse shaft 21 may be an integral part of the horizontal portion 23*a* of the ski brake.

What is claimed is:

1. A ski boot heel binding equipped with a ski brake comprising:

a base plate adapted to be attached to a ski plate;

a heel supporting body mounted on said base plate for sliding movement relative thereto in forward and rearward directions, said supporting body having a pair of side walls, an interior chamber, and a forward end supporting a heel engaging jaw;

a transverse shaft rotatably supported by said side walls of said supporting body and movable therewith;

a ski brake arm rigidly fixed to said transverse shaft and rotatable therewith between a braking position whereat said arm extends below the bottom of the ski plate and a non-braking position whereat said arm is above the bottom of the ski plate;

lever means, positioned within said chamber of said supporting body and rigidly fixed to said transverse shaft and connected to a stationary portion of said base plate, for, upon rearward sliding moement of said supporting body when a ski boot is engaged with said jaw, causing said transverse shaft and thereby said arm to rotate to said non-braking position; and spring means, positioned within said chamber of said supporting body, for normally urging said supporting body forwardly with respect to said base plate, and for thereby urging said lever means to rotate said transverse shaft and said arm to said braking position, but allowing rearward movement of said supporting body relative to said base plate when the ski boot is engaged with said jaw.

2. A ski boot heel binding equipped with a ski brake as claimed in claim 1, wherein said lever means comprises first and second levers pivoted to each other at first ends thereof, said first lever being rotatably connected at a second end thereof to said stationary portion of said base plate, and said second lever being rigidly fixed at a second end thereof to said transverse shaft.

3. A ski boot heel binding equipped with a ski brake as claimed in claim 1, wherein said lever means comprises a single lever rigidly fixed at a first end thereof to said transverse shaft, one of said lever and said stationary portion of said base plate being provided with a cut-out portion and the other of said lever and said stationary portion of said base plate including a pin, said cut-out portion and said pin being engaged with each other in such a manner that when said supporting body slides along said base plate, said lever partially rotates about said pin.

4. A ski boot heel binding equipped with a ski brake as claimed in claims 1, 2 or 3, wherein said transverse shaft comprises a hollow shaft member rotatably supported by said side walls of said supporting body, said ski brake arm includng a horizontal end portion firmly engaged in the hollow space of said shaft member.

5. A ski boot heel binding equipped with a ski brake as claimed in claim 3, wherein said lever includes said cut-out portion which is formed to provide bifurcated fingers between which said pin, fixedly provided on said base plate, is interposed to be slidable therebetween.

6. A ski boot heel binding equipped with a ski brake as claimed in claim 5, wherein said pin is provided on a side wall of a spring-receiving member which is stationary relative to said base plate.

7. A ski boot heel binding equipped with a ski brake as claimed in claim 6, wherein said spring-receiving member has a horizontal guide slit which allows said transverse shaft to move back and forth when said supporting body slides along said base plate.

* * * * *